US005156306A

United States Patent [19]

Perera

[11] Patent Number: 5,156,306

[45] Date of Patent: Oct. 20, 1992

[54] FLUID DISPENSER

[75] Inventor: Guruge E. L. Perera, Wembley, England

[73] Assignee: The General Electric Company, p.l.c., England

[21] Appl. No.: 638,103

[22] Filed: Jan. 4, 1991

[30] Foreign Application Priority Data

Jan. 5, 1990 [GB] United Kingdom ..... 9000223.9

[51] Int. Cl.[5] ..... B65D 88/54

[52] U.S. Cl. ..... 222/318; 222/394; 222/399; 222/486

[58] Field of Search ..... 222/318, 486, 135, 136, 222/109, 132, 330, 394, 399, 478, 481, 482; 239/124, 127; 346/75, 140 R

[56] References Cited

U.S. PATENT DOCUMENTS 4,057,807 11/1977 Fishbeck et al. ..... 346/140 R
4,390,886 6/1983 Sultan ..... 346/140 R
4,784,295 11/1988 Holmstrand ..... 222/318 X
4,793,515 12/1988 Shannon et al. ..... 222/318 X

FOREIGN PATENT DOCUMENTS 975724 10/1975 Canada ..... 222/318
0025877 4/1981 European Pat. Off. .
2700010 7/1977 Fed. Rep. of Germany .

*Primary Examiner*—David H. Bollinger
*Attorney, Agent, or Firm*—Kirschstein, Ottinger, Israel & Schiffmiller

[57] ABSTRACT

A fluid dispenser for use, for example, in an ink jet printing head, comprises a switching device, preferably a bistable fluidic device, which switches fluid under pressure between a path in which the fluid circulates back to the fluid source and a second path in which it issues from a jet. The fluidic device is preferably formed by micro-machining cavities in a silicon substrate, or in two substrates which are then bonded together face to face. A printing head may be formed by locating a number of the dispensers in side-by-side relation with spacers therebetween, the spacers being used to provide feed paths for the ink.

11 Claims, 2 Drawing Sheets

FLUID DISPENSER

BACKGROUND OF THE INVENTION

1. Field of the Invention

This invention relates to a fluid dispenser and particularly, but not exclusively, to a dispenser for dispensing very small quantities of a fluid, such as printing ink, at a rapid rate, on demand. The device is therefore particularly suitable for use in an ink jet printing head.

2. Description of Related Art

FIG. 1 of the accompanying drawings is a schematic cross-sectional view of a known type of fluid dispenser, as used, for example, in drop-on-demand print head. The dispenser 1 includes a fluid supply system 2, comprising a reservoir 3 which is connected to a main chamber 4 of the dispenser via a pipe 5. A drive mechanism 6, which may be a piezo-electric driver, is fitted to one end of the chamber 4, and an outlet jet 7 is provided at the opposite end. The drive mechanism 6 acts as a reciprocating pump. On the outward stroke of the mechanism the fluid, such as printing ink, is drawn into the chamber from the reservoir, and on the forward stroke the fluid is pushed towards the jet 7, so that a drop of fluid is ejected therefrom.

The quality of such a dispenser is determined by the quantity of fluid ejected at each stroke of the drive mechanism, the velocity with which the fluid is ejected, and the ejection time. For a given geometry of the chamber, the pressure at which the fluid is supplied to the chamber and the characteristics of the drive mechanism determine all of those parameters. By increasing the supply pressure and the displacement of the drive mechanism in the forward stroke, either independently or as combined parameters, the ejection quality can be improved. However, if the supply pressure is to be increased above the pressure at the outlet of the jet (which in print heads is generally atmospheric pressure), the fluid column cannot be contained in the chamber during the off periods of the dispenser, i.e. during the periods when no fluid is to be ejected from that particular jet. Fluid will therefore drip out of the jet during those periods.

Hence, the single most influential parameter in achieving high-quality ejection on demand in these known dispensers is the maximum obtainable displacement of the drive mechanism, which is clearly limited.

SUMMARY OF THE INVENTION

It is an object of the present invention to provide an improved fluid dispenser.

According to the invention there is provided a fluid dispenser, comprising a chamber; fluid supply means for feeding fluid to the chamber under pressure; first and second fluid flow paths of mutually comparable flow resistance via which pressurised fluid can flow out of the chamber, said first path including a fluid dispensing nozzle; and switching means to cause the flow of fluid out of the chamber to switch between said paths, whereby said flow follows said first path when dispensing of fluid is required and otherwise follows said second path.

Said second path is preferably coupled back to the chamber, and may include the fluid supply means.

Preferably the switching means comprises a bistable fluidic device.

BRIEF DESCRIPTION OF THE DRAWINGS

An embodiment of the invention will now be described, by way of example only, with reference to the accompanying drawings, in which.

DETAILED DESCRIPTION OF THE PREFERRED EMBODIMENTS

Figure 2:
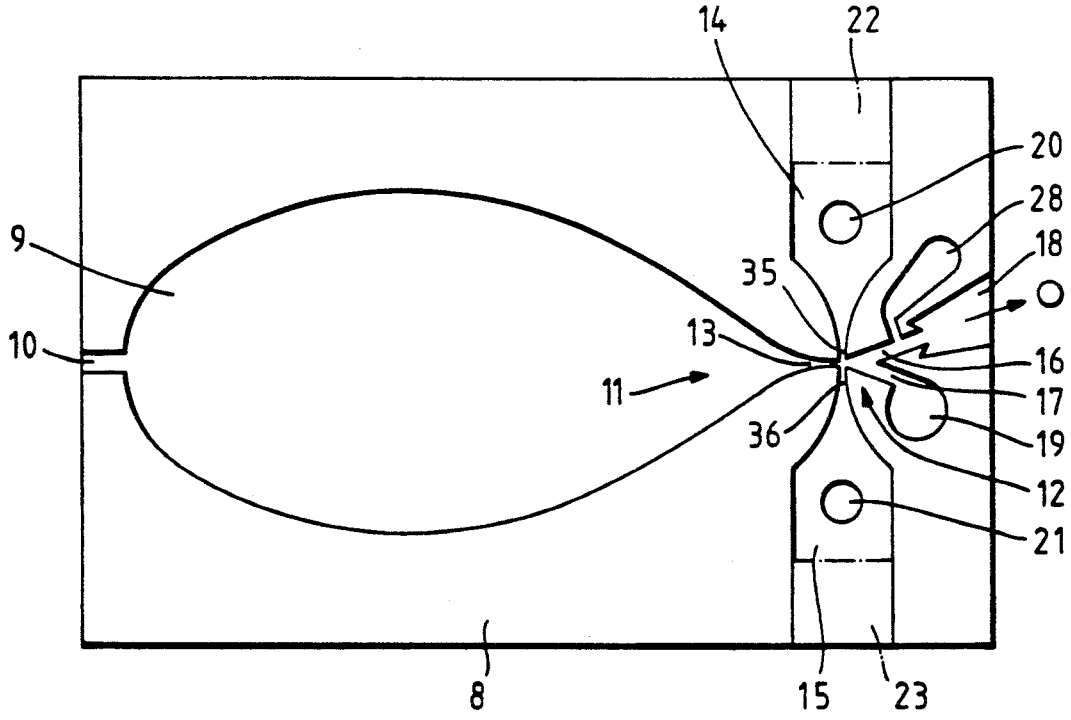
FIG. 2 is a schematic plan view of a fluid dispenser in accordance with the invention.

FIG. 2 of the drawings shows, schematically, a fluid dispenser in accordance with the invention. The dispenser comprises a silicon substrate 8 into which is machined a main chamber 9 to which fluid is fed under pressure via an inlet 10. At an outlet end 11 of the chamber is a bistable fluidic device 12 comprising an inlet channel 13, control chambers 14 and 15, and outlet channels 16 and 17. The outlet channel 16 leads to a dispensing nozzle 18, whilst the outlet channel 17 conducts the fluid back into the chamber 9 via a port 19 and a connecting path (not shown). Alternatively, the channel 17 might be arranged to conduct the fluid back to the fluid supply (not shown).

In use of the dispenser, fluid is fed under pressure to the main chamber 9 via the inlet 10, the pressure being applied to the fluid by, for example, a cylinder of gas (e.g. $CO_2$), a compressor, a pump or other suitable means. The pressurized fluid enters the inlet channel 13 of the fluidic device 12. Fluid also enters the control chambers 14 and 15 via ports 20 and 21, respectively. At the outer ends of the control chambers 14 and 15 are driver devices 22 and 23, respectively,, (shown dotted) either of which can be energised, exclusively of the other, to increase the fluid pressure in the respective control chamber. The driver devices may be, for example, piezoelectric devices (e.g. PZT-5A), micro-pumps, co-polymer vinylidene (PVDF) devices, or any other device which is operable to provide the required small control pressure in the selected chamber. The bistable fluidic device operates in such a manner that if the driver device 22 is energised, the fluid pressure in the control channel 14 will cause the fluid entering the inlet channel 13 to veer towards the outlet channel 17 and thence back to the chamber or to the fluid supply, as the case may be. Even if the driver device 22 is subsequently de-energised, the fluid will continue to follow the path through the outlet channel 17, by virtue of the Coanda effect.

If a drop of fluid is to be dispensed from the nozzle 18, the driver device 23 is momentarily energised instead of the driver device 22, so that the fluid flow from the main chamber 9 switches over to the outlet channel 16 and fluid is dispensed from the nozzle 18. As soon as the required quantity of fluid has been dispensed, the flow is switch back to the channel 17 by re-energisation of the driver device 22, so that the fluid again circulates back to the main chamber or to the fluid supply.

Hence, a given quantity of fluid can be dispensed, at high velocity, in a very short period, merely by suitably controlling the energising electric pulses fed to the driver devices 22 and 23. As no moving parts are required in order to effect the flow switching operation, high-speed switching can be readily achieved.

The chambers and channels in the substrate 8 may be formed by any suitable machining process. For use in an ink jet printing head, the dispenser will preferably be of dimensions which are of the order of microns, in which case micro-machining techniques will be used. The dispenser may be formed of two machined sections as described, one being the mirror image of the other, the sections then being bonded together face-to-face by any suitable process, such as thermal bonding using a gold film deposited on one or each of the faces to be bonded.

Figure 3:
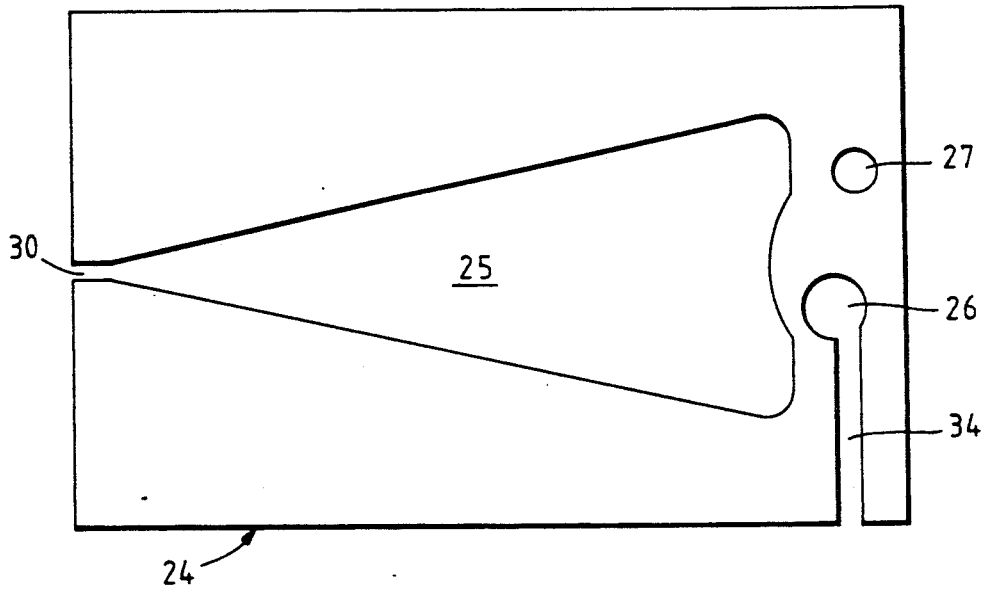
FIG. 3 is a schematic plan view of a spacer plate for use in forming a block of fluid dispensers.

Alternatively, a flat cover plate or a spacer may be bonded to the substrate 8 to cover the chamber 9 and the fluidic device 12. Such a spacer is shown in FIG. 3 of the drawings. The spacer 24 has a reservoir aperture 25 which is shaped to receive fluid via an inlet 30 and to feed it to the ports 20 and 21 of the control chambers (FIG. 2). The spacer also has apertures 26 and 27 which align with ports 28 and 19 (FIG. 2) respectively. The aperture 26 also has a slot 34 via which excess fluid can, if necessary, escape from the outlet channel 17. The spacer may conveniently by formed of borosilicate glass.

Figure 4:
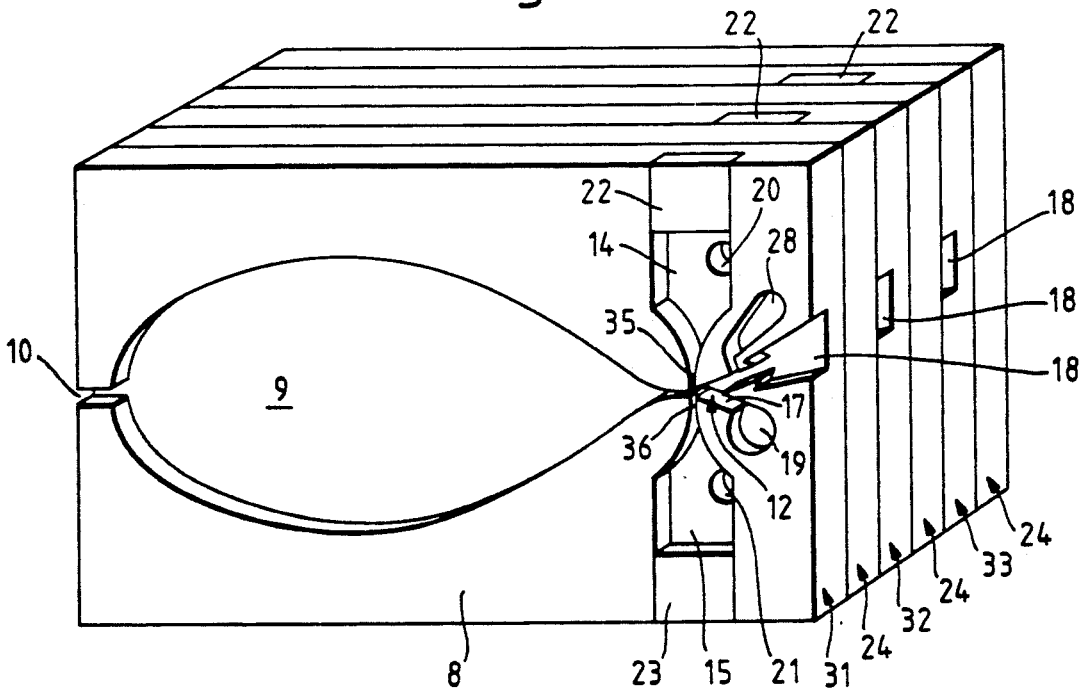
FIG. 4 is a schematic pictorial view of a block of fluid dispensers as in FIG. 2, arranged for use in an ink jet printing head.

Referring to FIG. 4, a block of dispensers of the kind described above with reference to FIG. 2, such as dispensers 31,32,33 can be assembled side-by-side, with spacers 24 bonded therebetween, to provide a row of output nozzles 18 for printing selected ones of a row of dots. The dots to be printed at any instant are selected by energisation of the relevant driver device or devices 23. When fluid is not being delivered from the nozzle 18 of any particular dispenser, fluid will be fed out of that dispenser via the respective outlet channel 17 and thence out through the port 26, through the apertures 22 of the spacers into a collection duct (not shown) and back to the fluid supply.

If necessary, more than two control chambers and fluid flow channels might be provided in the dispenser of FIG. 2.

The control fluid fed to either or each of the control chambers might be different from that being dispensed, and each control chamber might be fed with a respective different control fluid. Valves (not shown) might be located at the inlet 10 and/or at narrow ducts 35, 36 forming the outlets of the control chambers 14,15. Such valves could then be used to cut off the fluid supplies to the main chamber 9 and the control chamber outlets, respectively, whenever the particular dispenser remains in a quiescent (non-dispensing) state. The valves may be, for example, fluidic devices.

Figure 1:
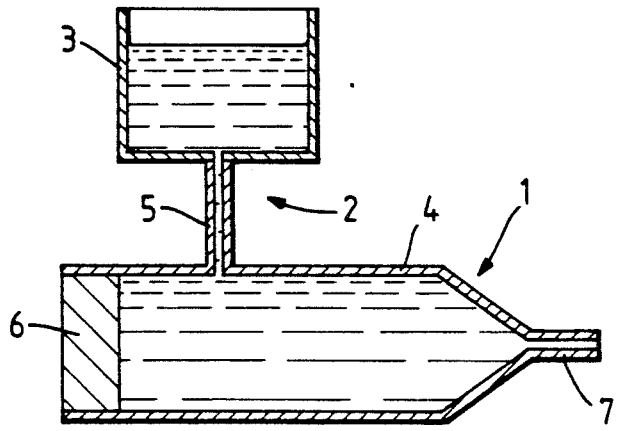
Fig. 1. PRIOR ART
FIG. 1 shows a schematic cross-section through a prior art fluid dispenser, as described above.

It will be seen that the dispensing parameters do not rely on the maximum displacement obtainable with a driver device 6, as in the prior art dispenser of FIG. 1. The fluid pressure is determined by the pressurised external fluid supply source. Only the relatively small control pressures in the control chambers 14 and 15 need to be provided by the driver devices 22 and 23.

The dispenser arrangement makes possible the production of a high-quality ink jet printer head. As the velocity of the jet leaving the nozzle 18 is controlled by the fluid supply source pressure and can therefore be high, printing on objects at a larger distance from the head than usual can be achieved. The flow rate through the nozzle is adjustable, so good-quality printing characters are possible. The micron dimensions of the described bistable fluidic device make possible a shortened fluid ejection time. A fluid dispenser formed from micro-machined silicon wafers is compact and light in weight, and is cheap and easy to fabricate in batch production. Furthermore, the dispenser is capable of working effectively, irrespective of its orientation. The lifetime of the dispenser is largely determined by the lifetime of the driver devices 22 and 23. These devices will experience relatively small stresses, and the design and operational parameters of the dispenser can alleviate most of the forms of cavitation. A long life can therefore be expected for the dispenser.

Existing hot-melt inks may be dispensed by the device.

A matrix array of jets may be produced in a compact printing head which could achieve different character sizes, on demand, by manipulation of software related to driver device control and paper feed control.

The micron-sized dispenser described above may be controlled by a fluid logic control system, which may have advantages over control systems using integrated circuits, particularly as regards reduced susceptibility to high voltage, high temperatures and sources of interference.

Although the preferred embodiment described above makes use of a bistable fluidic device as a very convenient device for switching the fluid flow between the recirculating path and the dispensing path, other types of switching device might be used.

Furthermore, although the provision of a micron-sized dispenser is very advantageous for the ink jet printing field, a dispenser in accordance with the invention could alternatively be used for other purposes, such as for dispensing controlled doses of drugs.

I claim:

1. A fluid dispenser, comprising a chamber; fluid supply means for feeding a fluid under pressure into the chamber; first and second fluid flow paths through which the fluid under pressure flows out of the chamber, said first path having a flow resistance and including a fluid dispensing nozzle, said second path having a flow resistance corresponding to the flow resistance of the first path; and fluidic switching means for directing the fluid to flow out of the chamber along the first path through the nozzle to dispense the fluid, and along the second path away from the nozzle when dispensing is not required.

2. A dispenser as claimed in claim 1, wherein said second fluid flow path extends to the chamber to conduct the fluid back into the chamber.

3. A dispenser as claimed in claim 1, wherein said second fluid flow path extends to the fluid supply means to conduct the fluid back to the fluid supply means.

4. A dispenser as claimed in claim 1, wherein the chamber and the fluidic switching means are provided on a common support member.

5. A dispenser as claimed in claim 4, wherein the support member comprises a substrate; and wherein the chamber and the fluidic switching means are machined recesses in said substrate, and a cover means bonded over the recesses.

6. A dispenser as claimed in claim 1, wherein cavities for forming the chamber and the fluidic switching means are formed in surfaces of two substrates and wherein the substrates are disposed with said surfaces mutually in contact.

7. A dispenser as claimed in claim 1, arranged to dispense printing ink.

8. A dispenser as claimed in claim 1, wherein the fluidic switching means comprises an inlet coupled to the chamber to receive the fluid flowing out of the chamber; two outlets coupled, respectively, to the dispensing nozzle and the second path; a switching path coupled between said inlet and said outlets; and control chamber means coupled to the switching path and operable by driver means to cause said fluid flow to switch between one of said outlets and the other of said outlets.

9. A dispenser head comprising a plurality of dispensers as claimed in claim 2, assembled in side-by-side relation with spacer means therebetween, the spacer means providing paths for fluid to enter the control chamber means and providing part of said second path.

10. A dispenser as claimed in claim 2, wherein said control chamber means comprises two control chambers operable selectively to cause said fluid flow to switch to a respective one of said outlets.

11. A dispenser as claimed in claim 10, wherein the driver means comprises a respective piezo-electric driver for each control chamber.

* * * * *